US009173470B2

(12) United States Patent
Park et al.

(10) Patent No.: US 9,173,470 B2
(45) Date of Patent: Nov. 3, 2015

(54) SKIN CARE DEVICE HAVING FUNCTION FOR MOVING VERTICALLY

(75) Inventors: Wooram Park, Seoul (KR); Jungsun Choi, Seoul (KR); Jooho Kim, Seoul (KR); Yoonkyun Hwang, Seoul (KR); Junoh Kim, Seoul (KR)

(73) Assignee: AMOREPACIFIC CORPORATION, Seoul (KR)

( * ) Notice: Subject to any disclaimer, the term of this patent is extended or adjusted under 35 U.S.C. 154(b) by 129 days.

(21) Appl. No.: 14/342,832

(22) PCT Filed: Sep. 3, 2012

(86) PCT No.: PCT/KR2012/007033

§ 371 (c)(1),
(2), (4) Date: Mar. 5, 2014

(87) PCT Pub. No.: WO2013/039303

PCT Pub. Date: Mar. 21, 2013

(65) Prior Publication Data

US 2014/0234005 A1 Aug. 21, 2014

(51) Int. Cl.

| | |
|---|---|
| ***A45D 33/02*** | (2006.01) |
| ***A61H 23/02*** | (2006.01) |
| ***A45D 33/36*** | (2006.01) |

(52) U.S. Cl.

CPC ..... *A45D 33/025* (2013.01); *A45D 33/36* (2013.01); *A61H 23/0218* (2013.01); *A61H 2201/0153* (2013.01); *A61H 2201/0157* (2013.01); *A61H 2201/105* (2013.01); *A61H 2201/1685* (2013.01)

(58) Field of Classification Search

CPC ..... A45D 33/02; A45D 33/025; A45D 33/34; A45D 2200/1018; A45D 2200/207; A61H 23/0218

USPC ..... 401/4, 118, 130, 196, 200, 205; 222/196, 200

See application file for complete search history.

(56) References Cited

U.S. PATENT DOCUMENTS 2,105,621 A * 1/1938 Testi ..... A45D 33/34 132/307
2,526,735 A * 10/1950 Duce ..... B05B 7/1404 222/196

(Continued)

FOREIGN PATENT DOCUMENTS

KR 20-0399929 Y1 11/2005
KR 10-0602426 B1 7/2006

(Continued)

OTHER PUBLICATIONS

International Search Report of PCT/KR2012/007033 dated Feb. 13, 2013.

*Primary Examiner* — David Walczak
*Assistant Examiner* — Bradley Oliver

(57) ABSTRACT

The present invention relates to a beauty apparatus comprising: a case unit comprising an upper case for accommodating powder and a lower case detachably attached to the upper case; a guide mounted to the lower case between the upper case and the lower case; a magnetic field generating unit mounted to an inside of the lower case between the guide and the lower case, for generating a time-varying magnetic field; a magnetic body coupling part moving through the guide within the lower case according to a change of a magnetic field; a movable plate mounted to the magnetic body coupling part passing through a guide hole formed in the guide on the magnetic body coupling part, for restricting movement of the magnetic body coupling part; and a puff pad enclosing the guide to vibrate according to movement of the movable plate.

9 Claims, 10 Drawing Sheets

(56) References Cited

U.S. PATENT DOCUMENTS

2012/0291798 A1* 11/2012 Park ..... A45D 33/006
132/293
2013/0006040 A1* 1/2013 Lee ..... A45D 33/26
600/15
2013/0333718 A1* 12/2013 Kim ..... A45D 33/36
132/293
2014/0345643 A1* 11/2014 Yoo, Il ..... A45D 33/36
132/288

FOREIGN PATENT DOCUMENTS

KR 20-2010-0008985 U 9/2010
KR 10-1058359 B1 8/2011

* cited by examiner

SKIN CARE DEVICE HAVING FUNCTION FOR MOVING VERTICALLY

CROSS REFERENCE RELATED APPLICATION

This application claims foreign priority of Korean Patent Application No. 20-2011-0008334, filed on Sep. 15, 2011, which is incorporated by reference in its entirety into this application.

TECHNICAL FIELD

The present invention relates to a beauty apparatus, and more particularly to a beauty apparatus having a vertical movement function in which a space securing boss is formed on a bottom surface of a guide accommodated in a puff pad such that a space in an interior of the puff pad can be secured even if the puff pad contacts skin of a user to apply a pressure to the skin, thereby improving an in-use feeling of the beauty apparatus.

BACKGROUND ART

In general, a makeup refers to an action of applying cosmetics to make a user of the cosmetics up pretty, and is used to help appealing portions of the body of the user and correct or camouflage defective portions of the user. The makeup is performed in the order of a sun cream, a makeup base, a primer, a BB cream, powder, and a color makeup after applying base cosmetics.

In particular, a user uses a puff to uniformly apply powder on a surface of his or her skin. The puff includes a product for applying powder by tapping the puff on the skin of a user while being fitted with a finger, and a product for applying powder on skin of the user by automatically vibrating the puff by using a motor.

An example of an automatic puff using the motor is shown in FIGS. 1A to 1C. FIGS. 1A to 1C are views for explaining problems of a conventional technology.

As shown in FIGS. 1A to 1C, the conventional automatic puff 5 includes a puff pad 2 mounted to a body 1 in which an electric motor is installed. The automatic puff 5 applies vibrations to the puff pad 2 while an operation shaft connected to the electric motor is rotated by rotating power of the electric motor to apply powder to skin of a user. However, although the conventional automatic puff can conveniently perform a makeup as compared with the manual puff used while being fitted with a finger, powder may not be easily applied when the automatic puff is used in skin having curves, for example, in a face of the user.

Further, in the conventional automatic pad, since a puff pad is mounted to an operation shaft, a movement distance of the puff is long, a speed of tapping skin of a user is slow, and it is difficult to adjust a tapping force. Further, in the conventional automatic puff, an interior space of the puff pad does not exist so that a space in which the operation shaft can move does not exist when a pressure is excessively applied while the automatic puff contacts the skin. Thus, since the conventional automatic puff cannot touch the skin softly, it may many conveniences to the user.

DISCLOSURE

Technical Problem

The present invention has been made in an effort to solve the above-described problems, and it is an object of the present invention to provide a beauty apparatus having a vertical movement function in which a space securing boss is formed on a bottom surface of a guide accommodated in a puff pad such that a minimum space can be secured even in an interior of the puff pad if the puff pad contacts skin of a user to apply a pressure to the skin, thereby improving an in-use feeling of the beauty apparatus.

Another object of the present invention is to provide a beauty apparatus having a vertical movement function that can adjust a frequency of a time-varying magnetic field for vibrating a puff pad to control a striking feeling applied to skin of a user.

Another object of the present invention is to provide a beauty apparatus having a vertical movement function that can prevent a magnetic field coupling part moving according to a time-varying magnetic field within a guide from deviating from the guide.

Technical Solution

In accordance with an aspect of the present invention, there is provided a beauty apparatus including: a case unit including an upper case for accommodating powder and a lower case detachably attached to the upper case; a guide mounted to the lower case between the upper case and the lower case; a magnetic field generating unit mounted to an inside of the lower case between the guide and the lower case, for generating a time-varying magnetic field; a magnetic body coupling part moving through the guide within the lower case according to a change of a magnetic field; a movable plate mounted to the magnetic body coupling part passing through a guide hole formed in the guide on the magnetic body coupling part, for restricting movement of the magnetic body coupling part; and a puff pad enclosing the guide to vibrate according to movement of the movable plate.

A space securing boss for maintaining a space in an interior of the puff pad even when the movable plate moves and contacts a bottom surface of the guide is mounted to a bottom surface of the guide.

The movable plate has a boss through-groove through which the space securing boss passes.

The guide has a flange extending to an inside of the guide hole, for restricting movement of the magnetic body coupling part.

The magnetic body coupling part includes: a movable plate mounting portion passing through the guide hole and to which the movable plate is mounted; a magnetic body positioning portion extending from the movable plate mounting portion and in which a magnetic body for moving the magnetic body coupling part according to a change of a magnetic field is positioned; and a flange contact portion connecting the magnetic body coupling part and the magnetic body positioning portion, for restricting movement of the magnetic body coupling part as the flange contact portion contacts a lower surface of the flange extending to an inside of the guide hole.

The beauty apparatus further includes a noise preventing unit formed on a bottom surface of the guide or a lower surface of the movable plate, for removing noise generated due to contact of the guide and the movable plate.

The beauty apparatus further includes a noise preventing unit formed on a lower surface of the flange extending to an inside of the guide hole, for restricting movement of the magnetic body coupling part or the flange contact portion for restricting movement of the magnetic body coupling part as the flange contact portion contacts a lower surface of the flange, for removing noise generated due to contact of the flange and the flange contact portion.

The magnetic field generating unit includes: an AC waveform generating part formed on a circuit board mounted to an inside of the lower case; a coil positioned within the lower case to enclose a magnetic body mounted to the magnetic body coupling part; and a controller formed on the circuit board to control an operation of the AC waveform generating part.

The magnetic field generating unit is electrically connected to a power source mounted to an inside of the lower case through an on/off operation of a switch mounted to an outside of the lower case.

Advantageous Effects

According to the beauty apparatus having a vertical movement function of the present invention, a space securing boss is formed on a bottom surface of a guide accommodated in a puff pad such that a minimum space can be secured even in an interior of the puff pad if the puff pad contacts skin of a user to apply a pressure to the skin, thereby improving an in-use feeling of the beauty apparatus.

Further, the beauty apparatus having a vertical movement function can adjust a frequency of a time-varying magnetic field for vibrating a puff pad to control a striking feeling applied to skin of a user.

Furthermore, the beauty apparatus having a vertical movement function can prevent a magnetic field coupling part moving according to a time-varying magnetic field within a guide from deviating from the guide.

BEST MODE

Mode for Invention

The above-described and other objects and new features of the present invention will become clearer with reference to the specification and the accompanying drawings.

Hereinafter, a beauty apparatus having a vertical movement function according to an embodiment of the present invention will be described in detail with reference to FIGS. 2 to 5.

Figure 1A:
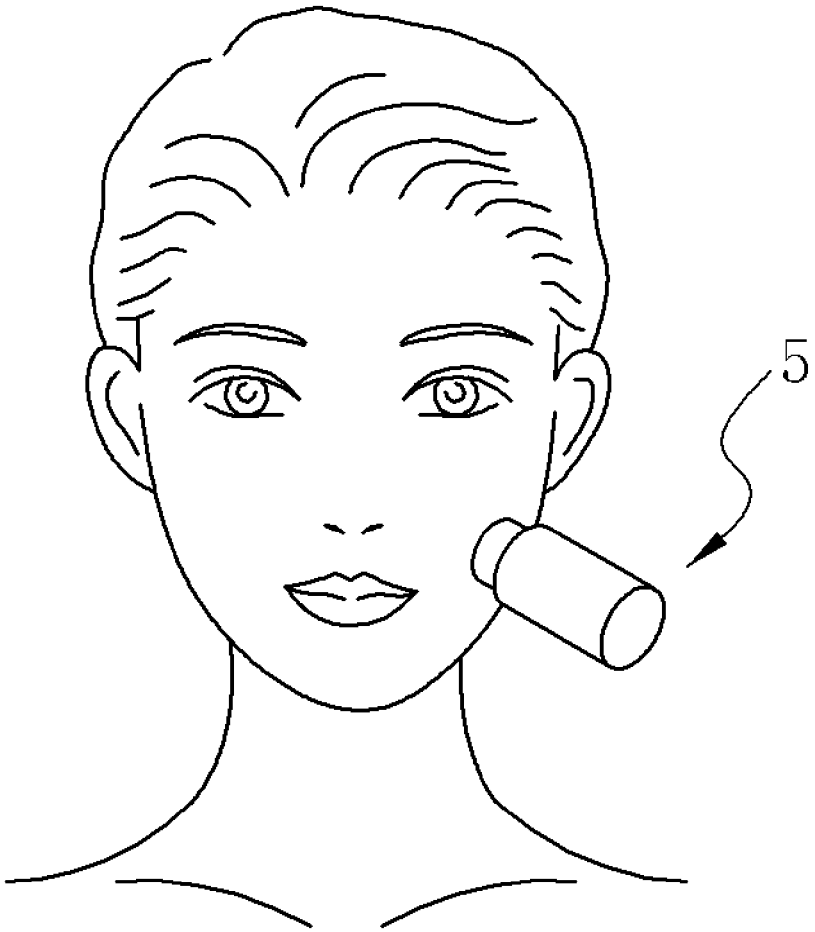
FIGS. 1A to 1C are views for explaining problems of a conventional technology.
Figure 1B:
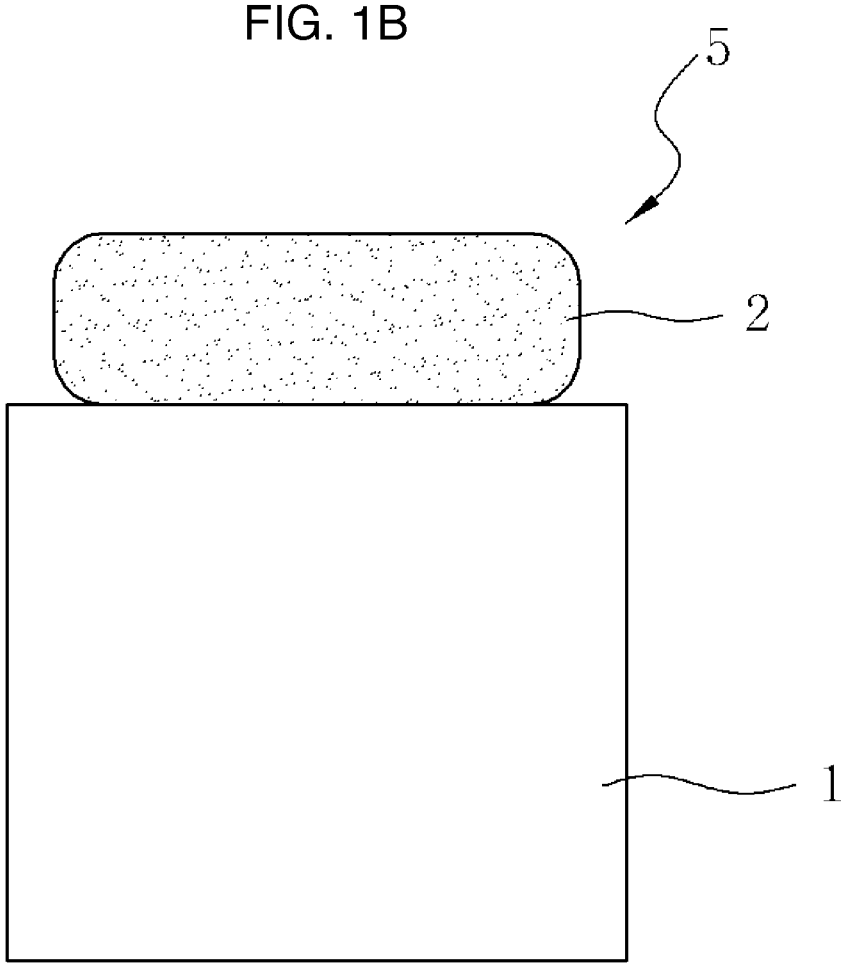
Figure 1C:
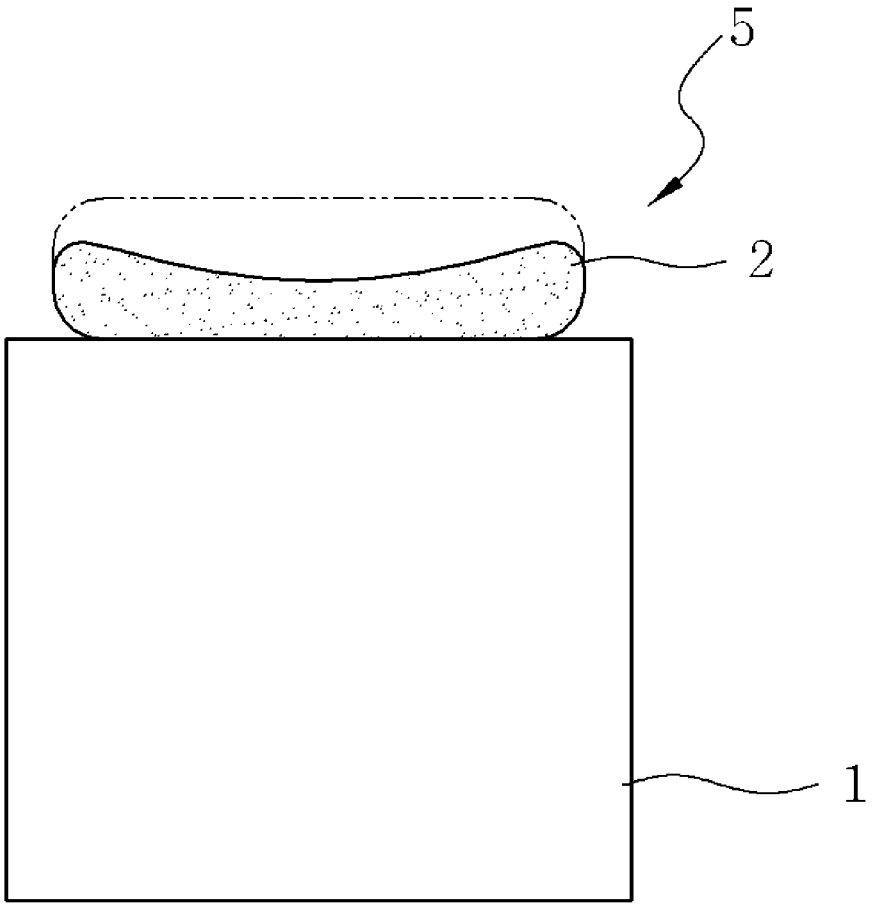
Figure 2:
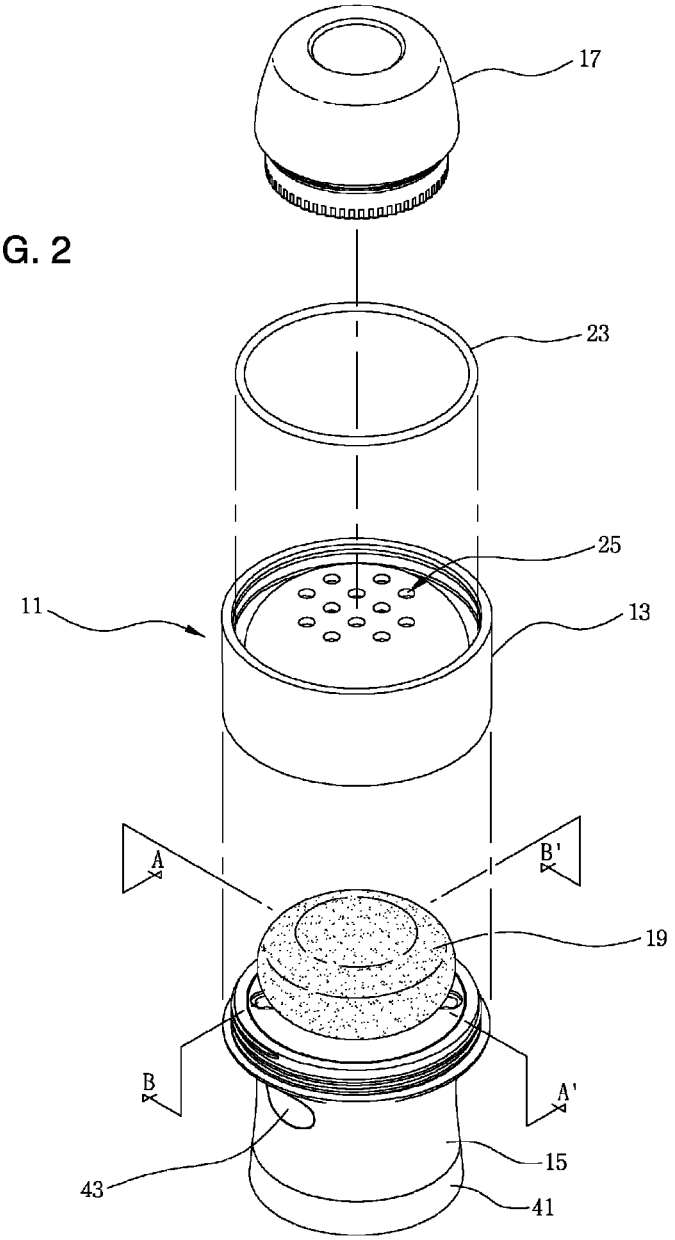
FIG. 2 is a perspective view showing a beauty apparatus having a vertical movement function according to an embodiment of the present invention.
Figure 3:
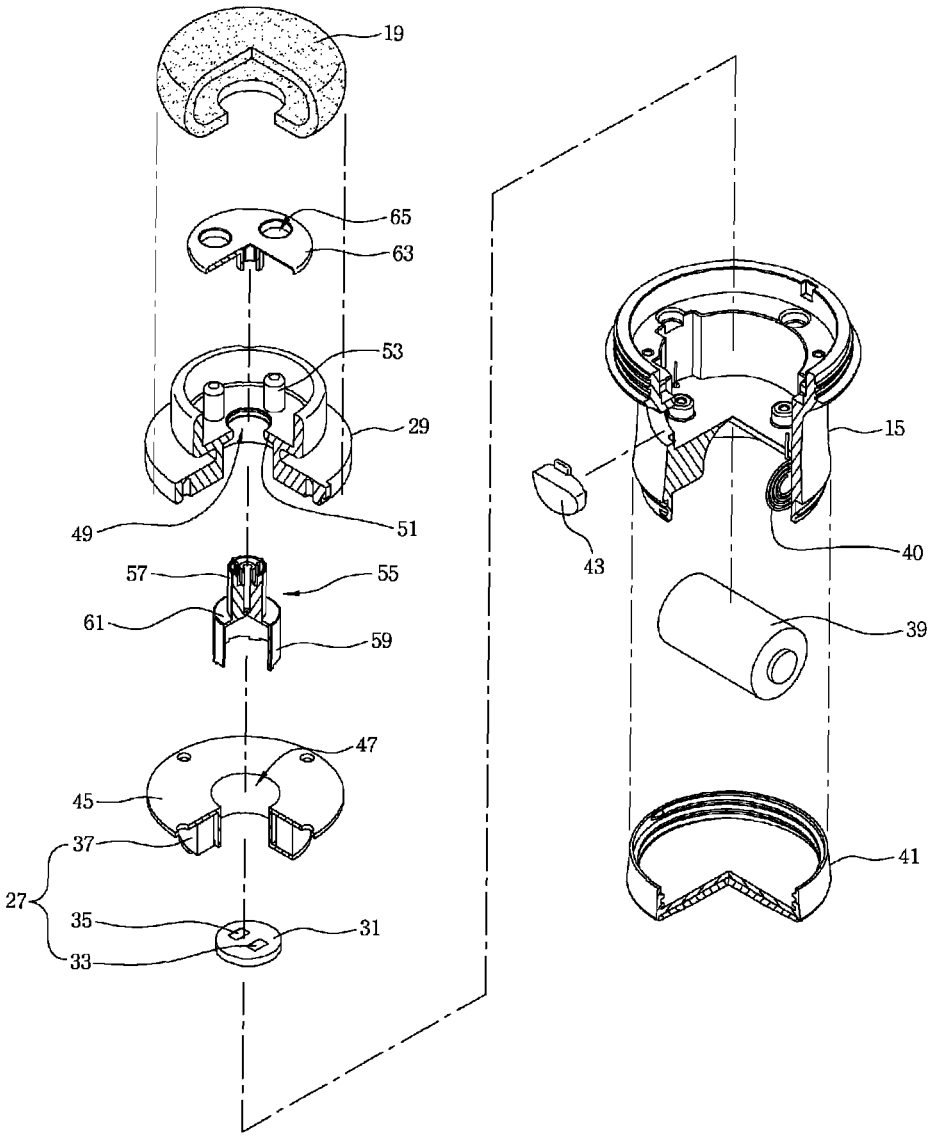
FIG. 3 is a partially sectional exploded view showing the beauty apparatus according to the embodiment of the present invention.
Figure 4A:
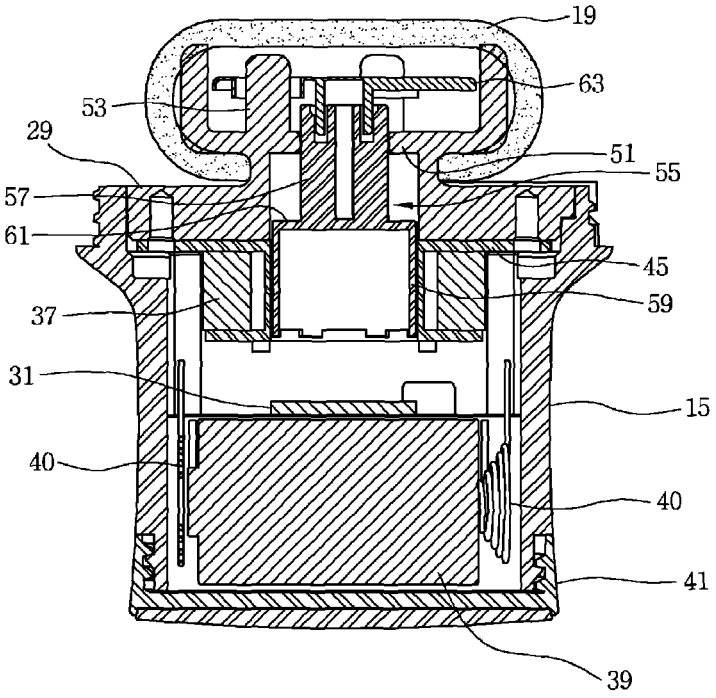
FIGS. 4A and 4B are sectional views taken along line A-A' and B-B' of FIG. 2.
Figure 4B:
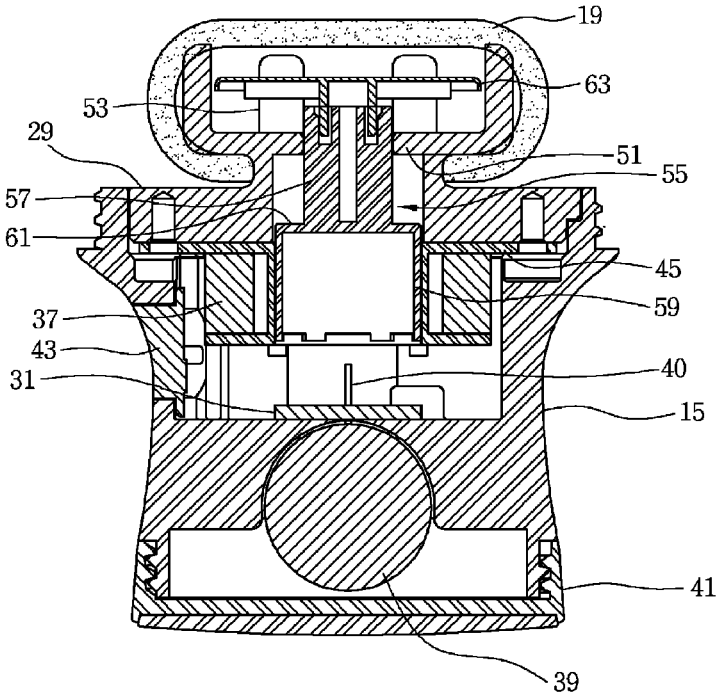
Figure 5:
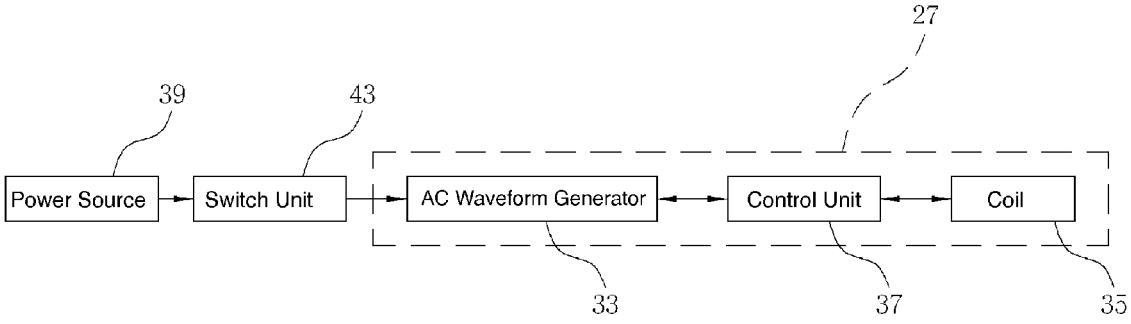
FIG. 5 is a block diagram schematically showing an operation circuit applied to the beauty apparatus according to the embodiment of the present invention.
Figure 6A:
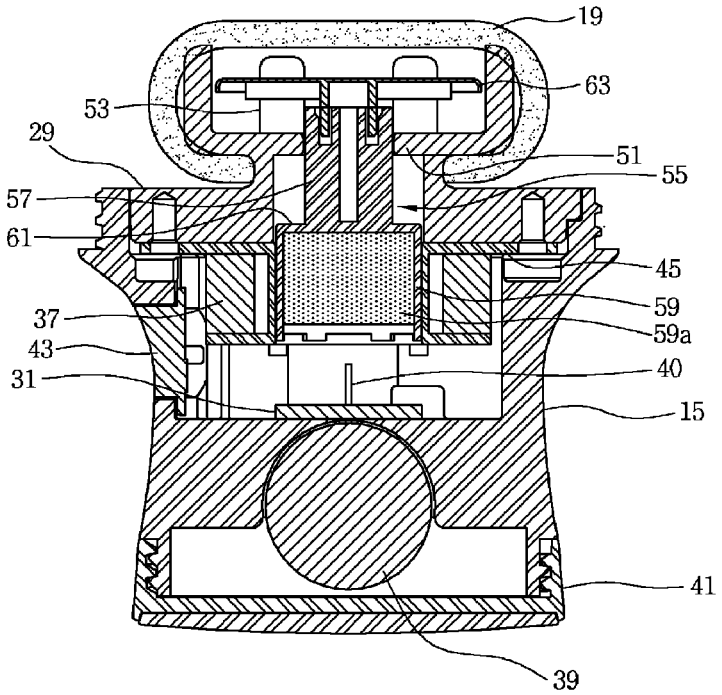
FIGS. 6A to 6B are views showing an operation of the beauty apparatus having a vertical movement function according to the embodiment of the present invention.
Figure 6B:
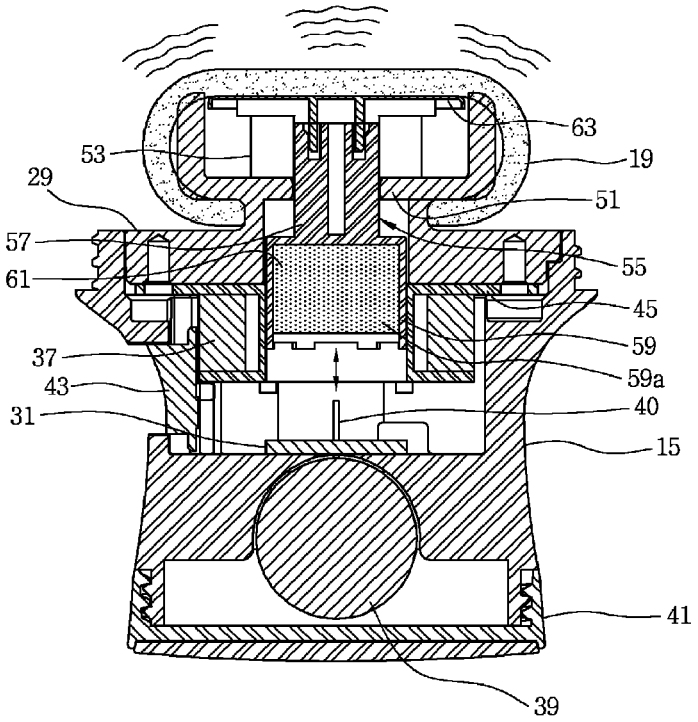

FIG. 2 is a perspective view showing a beauty apparatus having a vertical movement function according to an embodiment of the present invention. FIG. 3 is a partially sectional exploded view showing the beauty apparatus according to the embodiment of the present invention. FIGS. 4A and 4B are sectional views taken along line A-A' and B-B' of FIG. 2. FIG. 5 is a block diagram schematically showing an operation circuit applied to the beauty apparatus according to the embodiment of the present invention. FIGS. 6A to 6B are views showing an operation of the beauty apparatus having a vertical movement function according to the embodiment of the present invention.

Referring to FIGS. 2 to 5, the beauty apparatus according to the present invention includes a case unit 11. The case unit 11 includes an upper case 13 for accommodating powder, and a lower case 15 detachably attached to the upper case 13. The upper case 13 and the lower case 15 define an interior space when being coupled to each other. It is preferable that the upper case 13 and the lower case 15 are screw-coupled to each other such that they are attached to or detached from each other.

The upper case 13 includes a powder accommodating portion 17 for accommodating powder, and a pad accommodating portion 21 for accommodating a puff pad 19. The powder accommodating portion 17 is screw-coupled to the pad accommodating portion 21 to be attached to or detached from the pad accommodating portion 21. A packing unit 23 for securely sealing the powder stored in the powder accommodating portion 17, for example, an O-ring may be mounted on an inner wall of the pad accommodating portion 21 to which the powder accommodating portion 17 is mounted. The pad accommodating portion 21 includes a powder moving hole 25 for supplying powder to the puff pad 19.

Meanwhile, a magnetic field generating unit 27 and a guide 29 are sequentially located from a bottom surface of the lower case 15 between the upper case 13 and the lower case 15. The magnetic field generating unit 27 generates a time-varying magnetic field. The magnetic field generating unit 27 includes an AC waveform generating part 33 formed on a circuit board 31 mounted to an inside of the lower case 15, a coil 35, and a controller 37. The circuit board 31 is electrically connected to a power source 39 mounted to a lower portion of the lower case 15 by an electrode contact piece 40. In this case, the power source 39 may include a DC power source, for example, a primary battery or a secondary battery that is commercial, and a lower cap 41 attached and detached through screw-coupling is detachably attached to a lower portion of the lower case 15 to be easily replaced.

The AC waveform generating part 33 is electrically connected to the power source 39 through a switch 43 passing through the lower case 15. The AC waveform generating part 33 may convert a DC voltage input from the power source 39 to an AC voltage and supplies the AC voltage of the coil 35. For example, the AC waveform generating part 33 generates a pulse by using a timer IC, determines a frequency and a duty ratio of the puff pad 19 by using a time constant, and may apply an AC voltage to the coil 35 by applying an H-bridge circuit including four transistors. In this case, the switch 43 may be a tack switch that is operated only while being pressed and interrupts flow of a current applied to the AC waveform generating part 33 when being switched off.

The coil 35 is wound in a cylindrical coil accommodating part 45 mounted to the lower case 15, and the coil accommodating part 45 has a magnetic body through-hole 47 in which a magnetic body is located. An attractive force and a repulsive force are applied to the magnetic body according to a change of a magnetic field generated by the coil 35 such that the magnetic body moves in the magnetic body through-hole 47. The controller 37 controls an operation of the AC waveform generating part 33 formed on the circuit board 31 to determine a frequency of the puff pad 19.

Meanwhile, the guide 29 is mounted inside the lower case 15 above the coil accommodating part 45. The guide 29 includes a guide hole 49, a flange 51, and a space securing boss 53. A magnetic body coupling part 55 to which the magnetic body is coupled such that the magnetic body moves according to a change of a magnetic field generated by the coil 35 is located in the guide hole 49. In this case, it is preferable that the magnetic body coupling part 55 moves within the magnetic body through-hole 47 of the coil accommodating part 45 and the guide hole 49 of the guide 29.

The flange 51 extends to an inside of the guide hole 49 to restrict movement of the magnetic body coupling part 55. That is, the flange 51 may prevent the moving magnetic body coupling part 55 from being withdrawing to the outside of the guide 29. The space securing boss 53 protrudes from a bottom surface of the guide 29 within the puff pad 19. It is preferable that a plurality of space securing bosses 53 are provided. When the puff pad 19 contact skin of a user to be pressed, the space securing boss 53 maintains a predetermined space in the puff pad 19 such that the puff pad 19 transfers vibrations constantly along a curve of the skin. Thus, the space securing boss 53 attaches the puff pad 19 to the skin and generates vibrations to improve an in-use feeling of the puff pad 19.

The magnetic body coupling part 55 moves along the magnetic body through-hole 47 and the guide hole 49 of the guide 29 according to a change of a magnetic field generated by the coil 35. The magnetic body coupling part 55 includes a movable plate mounting portion 57 passing through the guide hole 49, a magnetic body positioning portion 59, and a flange contact portion 61. The movable plate mounting portion 57 moves through the guide hole 49, and is coupled to a movable plate 63 that moves together with the magnetic body coupling part 55 on the guide 29. In this case, the movable plate 63 includes a boss through-hole 65 through which the space securing boss 53 passes.

The magnetic body positioning portion 59 extends from the movable plate mounting portion 57 and is located within the magnetic body through-hole 47. A magnetic body, for example, a magnet is mounted to the magnetic body positioning portion 59, and the magnet moves the magnetic body coupling part 55 according to a change in a magnetic field generated by the coil 35. It is preferable that the magnetic body positioning portion 59 is wider than the movable plate mounting portion 57. The flange contact portion 61 connects the movable plate mounting portion 57 and the magnetic body positioning portion 59, and contacts a lower surface of the flange 15 to restrict movement of the magnetic body coupling part 55 when the magnetic body coupling part 55 moves. Thus, the flange 51 and the movable plate 63 restrict a linear movement length of the guide 29 to adjust vibrations applied to the puff pad 19 by the movable plate 63.

In this case, a noise preventing unit (not shown) formed on a bottom surface of the guide 29 or a lower surface of the movable plate 63 to remove noise generated due to contact of the guide 29 and the movable plate 63 may be provided. For example, it is preferable that the noise preventing unit is formed of a material having a resilient force, such as sponge or rubber. Further, the noise preventing unit may be formed on a lower surface of the flange 51 or the flange contact portion 61 to remove noise generated due to contact of the flange 51 and the flange contact portion 61.

Next, an operation of the beauty apparatus having a vertical movement function according to the embodiment of the present invention will be described with reference to FIGS. 4B, 6A, and 6B.

FIGS. 6A and 6B are views showing an operation of the beauty apparatus having a vertical movement function according to the embodiment of the present invention.

Referring to FIGS. 4B, 6A, and 6B, since the beauty apparatus according to the present invention does not generate a magnetic field in the coil as a current is not applied to the AC waveform generating part 33 when the switch 43 is off, vibrations are not applied to the puff pad 19. However, when a user continuously maintains the switch 42 in an off state, a current is applied to the AC waveform generating part 33 such that an AC voltage is generated by the DC power source 39.

The AC voltage generates a time-varying magnetic field in the coil 35, and an attractive force and a repulsive force are alternately applied to a magnet 59*a* attached to the magnetic body positioning portion 59 by the time-varying magnetic field. The magnetic body coupling part 55 to which the magnet 59*a* is attached reciprocates between the magnetic body through-hole 47 and the guide hole 49, and the movable plate 63 that moves together with the magnetic body coupling part 55 generates vibrations of the puff pad 19 within the puff pad 19.

In this case, the beauty apparatus secures a minimum space in the puff pad 19 by using the space securing boss 53 attached to the guide 29 to improve an in-user feeling of the puff pad 19 attached to skin of the user.

Although the exemplary embodiment of the present invention has been described in detail, the present invention is not limited by the embodiment but may be variously modified without departing from the scope of the present invention.

DESCRIPTION OF REFERENCE NUMERALS

15: Lower case
19: Puff pad
27: Magnetic field generating unit
29: Guide
33: AC waveform generating part
35: Coil
39: Power source
43: Switch
45: Coil accommodating part
47: Magnetic body through-hole
49: Guide hole
51: Flange
53: Space securing boss
55: Magnetic body coupling part
57: Movable plate mounting portion
59: Magnetic body positioning portion
59*a*: Magnet
61: Flange contact portion
63: Movable plate
5: Boss through-hole

The invention claimed is:

1. A beauty apparatus comprising:

a case unit comprising an upper case for accommodating powder and a lower case detachably attached to the upper case;

a guide mounted to the lower case between the upper case and the lower case;

a magnetic field generating unit mounted to an inside of the lower case between the guide and the lower case, for generating a time-varying magnetic field;

a magnetic body coupling part moving through the guide within the lower case according to a change of a magnetic field;

a movable plate mounted to the magnetic body coupling part passing through a guide hole formed in the guide on the magnetic body coupling part, for restricting movement of the magnetic body coupling part; and a puff pad enclosing the guide to vibrate according to movement of the movable plate.

2. The beauty apparatus of claim 1, wherein a space securing boss for maintaining a space in an interior of the puff pad even when the movable plate moves and contacts a bottom surface of the guide is mounted to a bottom surface of the guide.

3. The beauty apparatus of claim 2, wherein the movable plate has a boss through-groove through which the space securing boss passes.

4. The beauty apparatus of claim 1, wherein the guide has a flange extending to an inside of the guide hole, for restricting movement of the magnetic body coupling part.

5. The beauty apparatus of claim 1, wherein the magnetic body coupling part comprises:

a movable plate mounting portion passing through the guide hole and to which the movable plate is mounted;

a magnetic body positioning portion extending from the movable plate mounting portion and in which a magnetic body for moving the magnetic body coupling part according to a change of a magnetic field is positioned; and a flange contact portion connecting the magnetic body coupling part and the magnetic body positioning portion, for restricting movement of the magnetic body coupling part as the flange contact portion contacts a lower surface of the flange extending to an inside of the guide hole.

6. The beauty apparatus of claim 1, further comprising a noise preventing unit formed on a bottom surface of the guide or a lower surface of the movable plate, for removing noise generated due to contact of the guide and the movable plate.

7. The beauty apparatus of claim 1, further comprising a noise preventing unit formed on a lower surface of the flange extending to an inside of the guide hole, for restricting movement of the magnetic body coupling part or the flange contact portion for restricting movement of the magnetic body coupling part as the flange contact portion contacts a lower surface of the flange, for removing noise generated due to contact of the flange and the flange contact portion.

8. The beauty apparatus of claim 1, wherein the magnetic field generating unit comprises:

an AC waveform generating part formed on a circuit board mounted to an inside of the lower case;

a coil positioned within the lower case to enclose a magnetic body mounted to the magnetic body coupling part; and a controller formed on the circuit board to control an operation of the AC waveform generating part.

9. The beauty apparatus of claim 8, wherein the magnetic field generating unit is electrically connected to a power source mounted to an inside of the lower case through an on/off operation of a switch mounted to an outside of the lower case.

* * * * *